US005346430A

United States Patent [19]

Baxter

[11] Patent Number: 5,346,430

[45] Date of Patent: Sep. 13, 1994

[54] NON-IMPACT PRINTING OF BUSINESS FORMS FROM CONTINUOUS WEBS HAVING ADHESIVE COATINGS

[75] Inventor: George Baxter, Youngstown, N.Y.

[73] Assignee: Moore Business Forms, Inc., Grand Island, N.Y.

[21] Appl. No.: 961,365

[22] Filed: Oct. 15, 1992

[51] Int. Cl.[5] ..... B41L 1/24; B41L 1/26

[52] U.S. Cl. ..... 462/2; 462/25; 462/55; 462/900

[58] Field of Search ..... 462/55, 2, 6, 7, 17, 462/25, 900

[56] References Cited

U.S. PATENT DOCUMENTS 4,050,361 9/1977 Traise .

FOREIGN PATENT DOCUMENTS 2701714 7/1978 Fed. Rep. of Germany .
2338794 8/1977 France .
WO85/02585 6/1985 World Int. Prop. O. .

*Primary Examiner*—Paul A. Bell
*Attorney, Agent, or Firm*—Nixon & Vanderhye

[57] ABSTRACT

In a method for producing composite carbonless copy business forms using non-impact printers, a CFB web having segmented glue lines across the width of both sides of the web. These glue lines adhere the CFB web to adjacent upper and lower CB and CF webs to seal together a business form. The glue lines on both sides of the CFB web are segmented such that the adhesive on the front of the web is laterally staggered from the adhesive on the back of the web. The staggering of the glue line ensures that the adhesive on the front of the web does not adhere to the adhesive on the back when the web is in a roll. Alternatively, the glue line on the CFB web is replaced with a line of holes that align with the glue lines on the CF and CB webs when the webs are registered together.

19 Claims, 3 Drawing Sheets

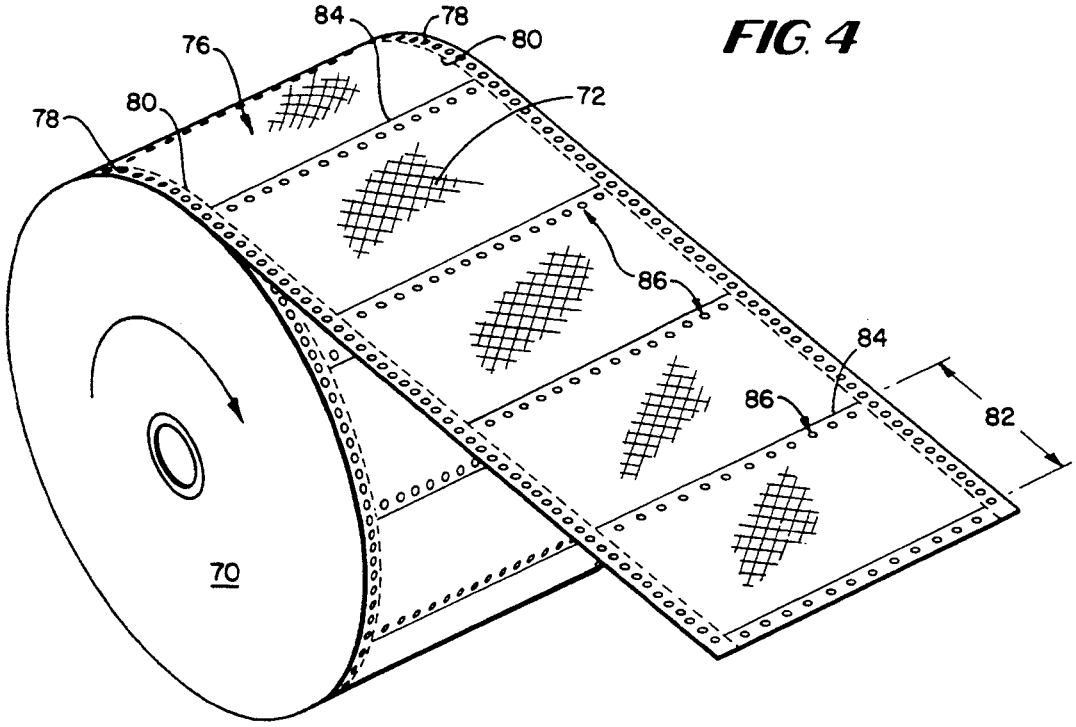
FIG. 4
FIG. 5
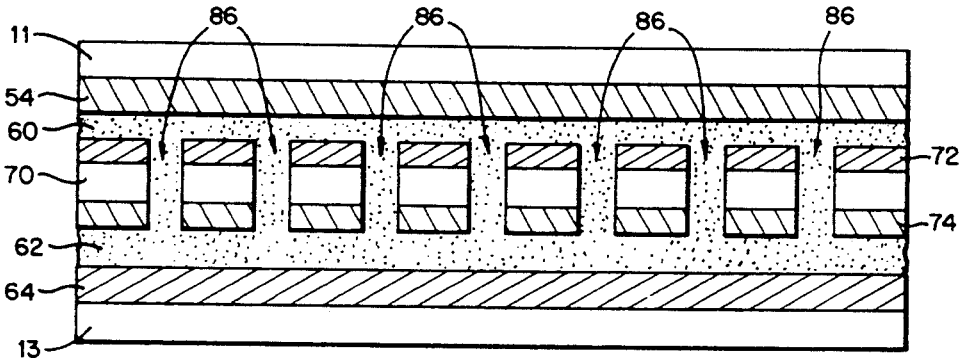

NON-IMPACT PRINTING OF BUSINESS FORMS FROM CONTINUOUS WEBS HAVING ADHESIVE COATINGS

FIELD OF INVENTION

This invention relates to the printing of business forms from continuous webs and, in particular, to non-impact printing of webs having adhesive coatings.

BACKGROUND AND SUMMARY OF THE INVENTION

High-speed non-impact printers, e.g., laser printers, have become increasingly popular for the production of carbonless business forms. In the past, cut sheets of paper have been fed into these printers for the production of business forms. However, it is often preferable for continuous webs, e.g., paper rolls and folded paper webs in cartons, to be used as the feed stock for the printer. High speed non-impact and laser printers that accept continuous paper webs are available. Examples of continuous web feed printers include the IBM printer models 3800, 3900, and 3835, and the Siemens printer models 2200, 2300, 2140 and 2090. Accordingly, there is a need for non-impact printing production methods using business forms from continuous welds.

Modern business forms are composites of two or more sheets secured together by adhesives. The adhesives are placed on the continuous web stock before the form is printed or assembled. To produce a business form, the continuous web stock is imprinted with text and graphics by the printer. The printed webs are collated, automatically cut into sheets, and sealed together as a business form. Alternatively, the printed continuous webs can be collated, sealed and later cut into sheet business forms.

The adhesives on the continuous weld stock are generally pressure or heat activated. In proper operation, the adhesive is activated by a heat/press sealer when the printed webs are aligned into composite business forms. However, a persistent problem has arisen when the adhesive on one side of the web adheres to the adhesive on the opposite side of the web while the web is in a rolled stock. If the adhesive binds to the rolled or folded web, then the adhesive can tear or bind the web while the web is fed to the printer. The printing and entire form production process is interrupted when the web tears or binds. Thus, the advantages in high speed processing offered by printing from a continuous web can largely be lost because adhesives bind the web and stop production. Accordingly, a need exists for a continuous web that can be fed to a non-impact printer without tearing or binding because of adhesives applied to the web.

It is especially difficult to avoid tearing and binding in webs where the adhesive is applied to the front and back sides of the web. The adhesive is applied to the front and back of the webs that are ultimately registered between two or more other webs. These middle webs often have carbonless copy material on the front and back, i.e., CFB (coated front and back), of the web. When a CFB web is rolled or folded before printing, the adhesive on the front adheres to the adhesive on the back side of the web. The combined adhesion of the front and back is great enough to tear the web and prevent the web from feeding smoothly into the printer.

A particularly vexing problem arises when adhesives are applied across the width of the web, either perpendicular to the longitudinal axis of the web or diagonally to the web axis. When the adhesive strips extend across the web, it is impossible to align the front and back adhesive strips so that they do not overlap when in the web roll. In contrast, adhesive strips parallel to the edge of the web and extending longitudinally with the web can be staggered to not overlap when the web is in a roll. Prior to the present invention, there were no known methods for applying adhesive strips laterally across the front and back of rolled webs such that the strips do not overlap when the web is rolled.

The present invention provides an arrangement and method for producing composite business forms from rolled continuous webs so that the adhesives across the width of the web do not tear or bind the web. In particular, the adhesive strips across the width of the web are segmented. The segmented strip on the front of the web does not overlie the segmented strip on the back of the web. Moreover, the segmentation of the strips on the front and back of the web are uniform for the entire web. Thus, when the web is rolled the adhesive strips on the front do not touch the adhesives on the back. This segmentation of the adhesive strips ensures that the adhesive from the front of the web does not directly overlie and adhere to the adhesive on the back of the web. In this arrangement, nowhere in the rolled web is one adhesive strip in direct contact with another adhesive strip. Accordingly, the propensity of the web to tear and bind is greatly diminished because two adhesive strips are not adhering to one another in the roll.

In an alternative embodiment, adhesive strips across the width of the CFB web are replaced by a line of holes. Since the rolled CFB web no longer has lateral adhesive strips, the likelihood of the web tearing or binding is greatly diminished over that for webs having adhesive strips. Instead of having adhesive strips, these CFB webs include perforated strips across the width of the web. When the CFB web is aligned between other webs, the perforated strips of the CFB web aligned with adhesive strips of the adjacent webs. The adhesive strips from the adjacent webs adhere through the holes in the middle CFB web.

In summary, the present invention includes an assembly of webs for constructing a carbonless multipart business forms being feed into a non-impact printer, said webs comprising: (1) a CB web having a plurality of glue strips extending laterally across at least a portion of the back of said CB web; (2) a CFB web having a plurality of segmented glue strips extending laterally across at least a portion of the back and front of the CFB web, the segmented glue strips on the front of the CFB web laterally staggered from the segmented glue strips on the back of the CFB web, the segmented glue strips on the front of the CFB web adhering to and aligned with corresponding glue strips on the CB web when the CFB web and CB web are registered; and (3) a CF web having a plurality of glue strips extending laterally across at least a portion of the front of the CF web, the glue strips on the CF web adhering to and aligned with corresponding segmented glue strips on the back of the CFB web when the CFB web and CF web are registered.

In another embodiment, the invention includes an assembly of webs for constructing a carbonless multipart business forms being feed into a non-impact printer, the webs comprising: (1) a CB weld having a plurality of glue strips extending laterally across at least a portion of the back of the CB web; (2) a CFB web having a plurality of holes extending laterally across at least a portion of the CFB web and a perforated tear line extending laterally across the CFB web, the tear resistance of the CFB web along the tear line being substantially less than the tear resistance of the CFB web along the holes, the holes aligned with the glue strip when the CFB web and CB web are registered together; and (3) a CF web having a plurality of glue strips extending laterally across at least a portion of the front of the CF web, the glue strips aligned with corresponding holes in the CFB web when the CFB web and CF web are registered, and the glue strips on the CF web adhering with corresponding glue strips on the CB web through the holes when the CB web, the CFB web and the CF web are registered together.

BRIEF DESCRIPTION OF THE DRAWINGS

The preferred embodiment of the invention is described in relation to the accompanying drawings. These drawings are as follows:

FIG. 4 is a perspective view of a rolled CFB web having lines of holes across the width of the web.

FIG. 5 is a cross-sectional view of the end of a composite business form including the CFB web shown in FIG. 4.

DETAILED DESCRIPTION OF THE DRAWINGS

Figure 1:
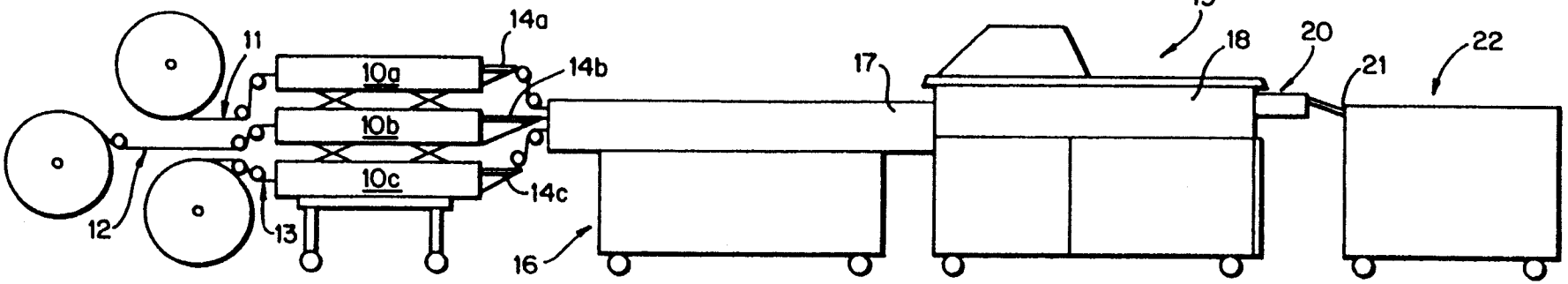
FIG. 1 is a schematic side view of exemplary equipment for business form production in accordance with the preferred embodiment of the invention.

Exemplary equipment according to the invention, and utilized to practice the method according to the invention, is illustrated schematically in FIG. 1. The equipment includes a high-speed, non-impact (e.g., laser) printers 10, such as an IBM 3800, 3900 or 3835; or a Siemens 2200, 2300, 2140 or 2090 printer. The printer 10*a* has at least one infeed line for feeding in continuous paper web 11 to the printer. It is also envisioned that the infeed line could be a tray or similar cut sheet feeder. The printer 10*a* also includes a printer discharge 14*a*. The printer discharge 14*a* is connected to an inlet conveyor for a conventional accumulator 16. In addition, conventional printers 10*b* and 10*c* have infeed lines for continuous papers webs 12 and 13. These printers have printer discharges 14*b* and 14*c* which are also connected to the inlet conveyor to the accumulator.

The accumulator 16 accumulates and aligns printed webs 11, 12 and 13 and/or sheets from the printers 10*a*, 10*b* and 10*c* so that they are in precisely aligned webs or stacks. They are ultimately discharged in precisely aligned webs or stacks from the accumulated stack discharge 17 of the accumulator 16. If feed directly from a printer to an accumulator is not desired, then a high-speed, stand-alone unit, such as a model 418 manufactured by GBR of Massachusetts, can be utilized.

The discharge 17 is connected to an inlet conveyor section 18 of a conventional pressure sealer 19, such as a Moore Business Forms, Inc., 4800B pressure sealer. The pressure sealer 19 applies pressure with narrow and segmented rollers, only above the strips of pressure-activated adhesive on the stacked webs or sheets fed from the accumulator 16, to permanently seal the web/-sheet edges together. The pressure sealer may seal one, two or any other number of strips, it being only necessary to align pressure sealing rollers with the strips that will be fed to the pressure sealer 19.

Instead of a pressure sealer, a heat sealer could be utilized, such as a Moore Heart Sealer Model 4200, or a Moore Edge Sealer.

Completed multipart forms are discharged from the discharge conveyor section 20 of the pressure sealer 19, being fed to an inlet to a collecting means 22. The collecting means 22—which may merely be a roller or a bin or tray (including a vertically-movable, horizontal collecting surface)—is connected to the discharge 20 from the pressure sealer 19. After the forms are collected in the collecting means 22, they may be acted upon as desired depending upon the use thereof. For example, if they are mailers, they can be folded and otherwise assembled into a final configuration, or if suitable additional equipment is utilized, a folder and another pressure sealer may be provided between the pressure sealer 19 and the collecting means 22 so that the collecting means 22 is connected to the pressure sealer 19 through the folder and additional pressure sealer.

As illustrated in FIG. 1, all of the pieces of equipment 10*a*, 10*b* and 10*c*, 16, 19, 22 can be mounted on wheeled supports. This allows the equipment components to be moved into ready operative association with each other. Alternatively, the printers 10*a*, 10*b* and 10*c* may be stationary printers while the rest of the equipment is mobile.

Figure 2:
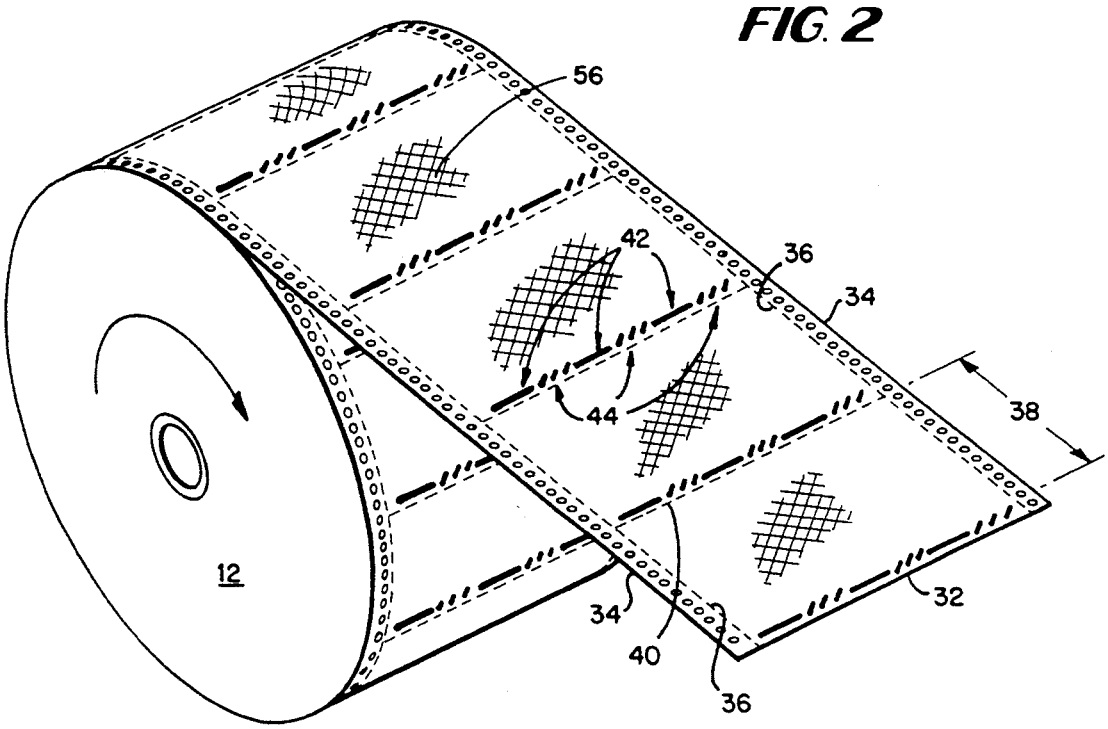
FIG. 2 is a perspective view of a rolled CFB web having segmented adhesive strips across the width of the front and back of the web.

FIG. 2 illustrates a web roll 12 of a CFB web. The continuous web includes a center business form section 32 bounded on either side by edge trim sections 34 each having a line of holes for engaging a tractor feeder. The tractor feeder propels the web into the printer and other processing equipment. The trim edges of the web are each separable from the form section along a perforated tear line 36. The trim edges are generally stripped from the web after the business form has been assembled and separated from the web.

The web is separable into individual business form sections 38 having a uniform form length extending longitudinally along the web. Each form section is separable from the web along a perforated tear line 40. A segmented glue line 42 extends across the width of the front of each form section 38. A similar segmented glue line 44 extends across the width of the back of each form section. These glue lines 42, 44 are aligned laterally across the web 12.

The glue lines 42, 44 of either side of the web are segmented such that the glue segments on the front of the web do not overlie the glue segments on the back of the web. The opposing glue lines on either side of the web are staggered. Moreover, the lateral positions of the glue segments on one side of the web are laterally offset from the glue segments on the opposite side of the web. One means of staggering the glue lines on the front of the web from those on the back is to segment and offset the glue lines uniformly along the entire length of the web.

The adhesives forming the glue lines are preferably pressure activated permanent adhesives of the type produced by Moore Business Forms of Lake Forest, Illinois, and utilized with the Moore 4800B pressure sealer. Alternatively, the glue lines may be formed of heat activated adhesives, such as that conventionally utilized with a Moore Heat Sealer Model 4200.

Positioning the segmented glue strips so that glue segments on one side of the web are staggered laterally from the glue segments on the other side of the web ensures that the glue segments do not overlap when the web is in a roll. Since the segments do not overlap, the glue on the front of the web is not positioned to contact or adhere to the glue on the back of the web. Moreover, each glue segment may be continuous or formed of glue spots. In addition, the end of one glue segment on one side of the web need not necessarily align with the end of a glue segment on the opposite side of the web.

Figure 3:
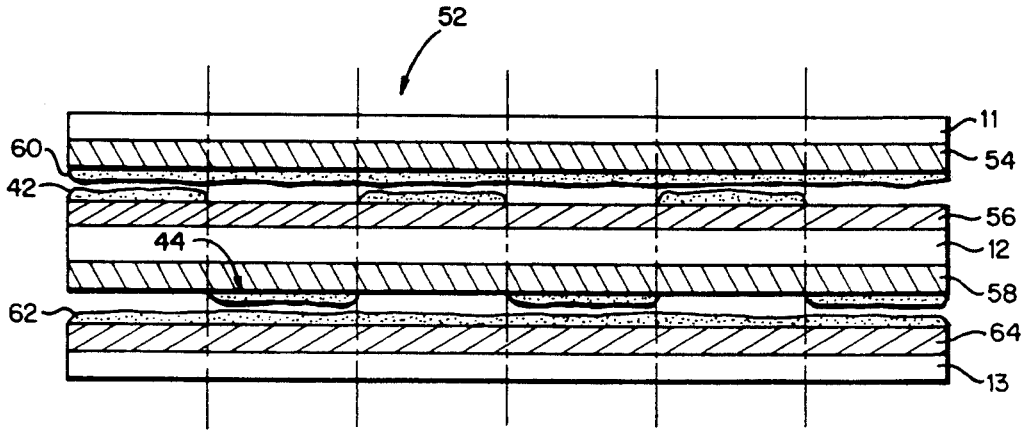
FIG. 3 is a cross-sectional view of the end of a composite business form including the CFB web shown in FIG. 2.

FIG. 3 shows an edge 52 in cross section of an assembled composite business form formed from three continuous webs 11, 12 and 13. The top CB web 11 is coated with a carbonless marking microcapsule color coating 54 on its back. The CFB middle web 12 is coated on front 56 with a carbonless copy receiving coating and back 58 with a carbonless marking microcapsule coating. The CF bottom web 13 is coated on its front with a carbonless copy receiving coating 64.

The segmented glue line 42 on the front side of the CFB web 12 adheres to a corresponding glue line 60 across the width of the CB web 11. Similarly, the segmented glue line 44 on the back of the CFB web adheres to a corresponding glue line 62 across the front of the CF web 13. The respective glue lines are applied to the webs such that they overlap when the webs are brought together and aligned. It has been found that the adhesion between the segmented glue strips on the CFB web and the glue strips on the CF and CB webs is sufficient to bind together the form. Of course, it is not necessary for the glue strips on the CF and CB webs to be continuous. However, it is preferable that these glue strips 60 and 62 provide adhesive that contacts the adhesive of the segmented glue strips on the CFB web when the strips are registered.

FIG. 4 shows a rolled CFB web 70 which is an alternative web to web 12 shown in FIG. 2. As with web 12, web 70 is coated with carbonless copy receiving coating on its front 72 and carbonless marking microcapsule coating on its back 74. The web comprises a middle business form section 76 and outer edge trim sections 78. The edge trim sections include a line of holes to engage a tractor feeder or other web propulsion device. The edge trim sections 78 are separable from the middle form section 76 by a perforated line 80. Similarly, the individual form sections 82 are separable from one another by perforated lines 84.

Web 70 has a line of holes 86 across the width of the web, instead of the segmented glue lines 42, 44 in web 12. The lines of holes are precisely positioned on the CFB web so as to align with the glue lines on webs 11 and 13 when the webs 11, 70 and. 13 are registered together in a composite form. Webs 11 and 13 are identical to the webs 11 and 13 shown in FIGS. 1 and 3.

As shown in FIG. 5, when the webs 11, 70 and 13 are registered together, the holes 86 across the width of web 70 allow the adhesives from the glue lines 60 and 62 on the CF and CB webs 11 and 13 to flow into the holes and adhere together. The engagement of the adhesives from the opposing glue lines 60 and 62 ensures a strong bond between all three webs. Thus, the webs 11, 70 and 13 are laterally secured together by the adhesion of the glue lines.

The web along the line of holes 86 is to have a greater resistance to tearing than along the perforated lines 84. This can be accomplished by sizing the perforations in lines 84 to be smaller and more numerous than the holes 86. Smaller holes increase the stress concentration on the surrounding web so as to increase the web's propensity to tear. Similarly, more numerous holes reduces the amount of webbing between the holes and, thereby, weakening the web across the line of holes 86.

Moreover, the longitudinal stress applied to the web 70 is greatest when the forms 82 are separated. This form separation occurs after the webs of the composite form have been glued together. The bonding of the glue increases the web resistance to tearing along the line of holes 86. The web should tear along perforated line 84, rather than across holes 86, when the individual forms are to be separated. In addition, the longitudinal stresses on the web before the webs 11, 70 and 13 are brought together is purposely maintained well below the tear strength of the web so that no tearing occurs across lines 84 or holes 86.

The invention has been described in what is currently considered to be its preferred embodiment. This invention is not limited to the disclosed embodiment. For example, the invention is applicable to business forms formed from more webs than the three webs shown here. The invention covers the various modifications and equivalent arrangements included within the spirit and scope of the appended claims.

What is claimed is:

1. An assembly of webs for constructing a carbonless multipart business forms, at least one web being fed into a non-impact printer, said assembly of webs comprising:

a coated back web having a plurality of back glue strips extending laterally across at least a portion of the back of said coated back web;

a coated front and back web having a plurality of segmented glue strips extending laterally across at least a portion of the back and front of said coated front and back web, said segmented glue strips on said front of said coated front and back web laterally staggered from the segmented glue strips on said back of the coated front and back web, said segmented glue strips on the front of the coated front and back web adhering to and aligned with corresponding back glue strips when said coated front and back web and coated back web are registered, and a coated front and back web having a plurality of glue strips extending laterally across at least a portion of the front of the coated front and back web, said front glue strips adhering to and aligned with corresponding segmented glue strips on said back of said coated front and back web when said coated front and back web and coated back web are registered.

2. An assembly of webs as in claim 1 wherein said segmented glue strips comprise pressure or heat or both activated adhesive.

3. An assembly of webs as in claim 1 wherein said segmented glue strips are noncontinuous spots of adhesive.

4. An assembly of webs as in claim 1 wherein said segmented glue strips are segmented and staggered such that the end of a glue segment on said front of said coated front and back web is laterally aligned with the end of a glue segment on said back of said coated front and back web.

5. An assembly of webs as in claim 1 wherein said coated front and back web is in a roll before being fed into said non-impact printer.

6. An assembly of webs as in claim 1 wherein said coated front and back web, said coated front and back web and said coated back web are each in individual rolls before being fed into an accumulator.

7. An assembly of webs as in claim 1 wherein said coated front and back web includes a plurality of coated front and back webs.

8. An assembly of webs as in claim 1 wherein said coated front and back web includes a plurality of coated front and back webs.

9. An assembly of webs as in claim 1 wherein said coated back web includes a plurality of coated back webs.

10. An assembly of webs for constructing a carbonless multipart business forms, at least one web being fed into a non-impact printer, said assembly of webs comprising:

a coated back web having a plurality of back glue strips extending laterally across at least a portion of the back of said coated back web;

a coated front and back web having a plurality of holes extending laterally across at least a portion of said coated front and back web and a perforated tear line extending laterally across said coated front and back web, the tear resistance of said coated front and back web along said tear line being substantially less than the tear resistance of said coated front and back web along said holes, said holes aligned with said back glue strip when said coated front and back web and coated back web are registered together, said holes each having an area fully covered by said back glue strips, and a coated front and back web having a plurality of front glue strips extending laterally across at least a portion of the front of the coated front and back web, said front glue strips aligned with corresponding said holes in said coated front and back web when said coated front and back web and coated back web are registered, and said front glue strips adhering with corresponding back glue strips through said holes when said coated back web, said coated front and back web and said coated front and back web are registered together.

11. An assembly of webs as in claim 10 wherein said front and back glue strips comprise pressure or heat or both activated adhesive.

12. An assembly of webs as in claim 10 wherein said front and back glue strips are noncontinuous spots of adhesives.

13. An assembly of webs as in claim 10 wherein said holes in said coated front and back web are substantially larger in area than the perforations in said perforated lines.

14. An assembly of webs as in claim 10 wherein said holes in said coated front and back web are substantially less numerous than the perforations in said perforated lines.

15. An assembly of webs as in claim 1 wherein said coated front and back web is in a roll before being fed into said non-impact printer.

16. An assembly of webs as in claim 1 wherein said coated front and back web, said coated front and back web and said coated back web are each in individual rolls before being fed into an accumulator.

17. An assembly of webs as in claim 1 wherein said coated front and back web includes a plurality of coated front and back webs.

18. An assembly of webs as in claim 1 wherein said coated front and back web includes a plurality of coated front and back webs.

19. An assembly of webs as in claim 1 wherein said coated back web includes a plurality of coated back webs.

* * * * *